US007044777B1

(12) United States Patent
Daly et al.

(10) Patent No.: US 7,044,777 B1
(45) Date of Patent: May 16, 2006

(54) MULTI-PORT MODULE RECEPTACLE

(75) Inventors: John J. Daly, Chicago, IL (US); Robert V. Skepnek, Norridge, IL (US); Alex Pirillis, Skokie, IL (US)

(73) Assignee: Methode Electronics, Inc., Chicago, IL (US)

( * ) Notice: Subject to any disclaimer, the term of this patent is extended or adjusted under 35 U.S.C. 154(b) by 483 days.

(21) Appl. No.: 10/062,979

(22) Filed: Jan. 31, 2002

(51) Int. Cl.
*H01R 13/60* (2006.01)

(52) U.S. Cl. ..... 439/540.1; 439/607

(58) Field of Classification Search ..... 439/79, 439/80, 540.1 I, 541.5, 607
See application file for complete search history.

(56) References Cited

U.S. PATENT DOCUMENTS 5,757,998 A * 5/1998 Thatcher et al. ..... 385/75
5,767,999 A * 6/1998 Kayner ..... 398/164
5,879,173 A 3/1999 Poplawski et al.
6,308,235 B1 10/2001 Scharf et al.
6,324,610 B1 11/2001 Lord et al.
6,502,998 B1 * 1/2003 Yen et al. ..... 385/88
6,511,345 B1 * 1/2003 Hwang ..... 439/541.5
6,524,134 B1 * 2/2003 Flickinger et al. ..... 439/607
6,558,191 B1 * 5/2003 Bright et al. ..... 439/541.5
6,558,196 B1 * 5/2003 Festag ..... 439/607
6,600,865 B1 * 7/2003 Hwang ..... 385/134
6,854,894 B1 * 2/2005 Yunker et al. ..... 385/53

OTHER PUBLICATIONS

SFF Committee, Information Specification, SFF-8074i Specification for SFP (Small Formfactor Pluggable) Transceiver Rev. 1.0, May 12, 2001.

* cited by examiner

*Primary Examiner*—Thanh-Tam Le
(74) *Attorney, Agent, or Firm*—Seyfarth Shaw LLP

(57) ABSTRACT

A multi-port receptacle assembly is provided having a housing forming multiple ports and having electrical connectors mounted within the ports so that upon assembly with a base via mounting features between the base and the housing a uniform multi-port assembly is provided that may be easily transported and installed to a motherboard.

16 Claims, 6 Drawing Sheets

MULTI-PORT MODULE RECEPTACLE

BACKGROUND OF THE INVENTION

The present invention pertains to a multi-port module receptacle and in particular a electrical receptacle having multiple ports for receiving a plurality of transceiver modules.

Receptacles for receiving electronic devices are known by such terms as cages, guide rails and/or sockets. In some applications the receptacle is individually assembled and receives a single module or electronic device therein. Having a single receptacle allows for the adjustability of using only the one receptacle when only a single transceiver is needed to be mounted. In situations where additional receptacles are needed a manufacturer may add only the amount desired for an application, such as a host device where the number of desired ports is unknown, it is useful to have the receptacle separately assembled and then mounted or assembled side-by-side when the number of desired ports is known. However, the use of individually-assembled receptacles has a disadvantage that multiple receptacles must be handled and assembled with the host device. The more ports that must be handled and assembled, the more labor and material costs involved. Therefore, there is desired a multi-port receptacle assembly of a single unit which has multiple ports.

Other known receptacles such as a small form factor pluggable (SFP) transceiver receptacle as disclosed in a Multi-Source Agreement (MSA) (SFF-80741) discloses individual cages to receive a single SFP transceiver therein. Each cage is assembled to a motherboard by mounting an electrical connector to a land grid array pattern on the motherboard, placing the assembled two-piece cage over the electrical connector on the motherboard and then assembling a bezel over the front opening of the cage. For each port that is desired, these steps must be repeated for each cage assembly. Since each electrical connector must be mounted separately to the motherboard, additional labor or time is required each time an electrical connector is mounted. Therefore, there is desired in an embodiment a modular receptacle having electrical connectors pre-installed into the receptacle; so that upon mounting of the entire modular receptacle, a multitude of electrical connectors will also be mounted simultaneously upon mounting of the entire modular unit.

SUMMARY OF THE INVENTION

A multi-port receptacle is provided comprising a housing defining at least two ports, each port including a first end defining an opening for receiving a module, a second end defining a wall, a passageway formed between the first end and the second end and a base having a cut-out portion adjacent the second end for receiving the electrical connector therein. In an embodiment, a first mounting guide is formed within the port adjacent the second end, and an electrical connector having a second mounting guide for slidingly mating with the first mounting guide within the port may be provided wherein the electrical connector is slidingly mounted at the second end of the port. In an embodiment, the multi-port receptacle housing may be formed of metal. In an embodiment, the housing may be formed of plastic. In an embodiment, the plastic housing may be metalized. In an embodiment, the plastic housing may be plated. In an embodiment, the housing is mounted to a base plate. In an embodiment, the base plate may be stamped metal. In an embodiment, the housing may include a first mounting feature and the base may include a second mounting feature wherein the first and second mounting features latch together in order to mate the housing to the base. In an embodiment, the first mounting feature on the housing may protrude from a side of the housing. In an embodiment, the second mounting feature may be a tab which receives the first mounting feature. In an embodiment, an electrical connector is provided which includes a channel on each side that corresponds to mounting features provided in the sides of each receptacle port so that the electrical connector may be slidingly mounted within a port. In an embodiment, the housing includes a nose having tabs protruding therefrom. In an embodiment, the base includes tabs protruding adjacent the nose portion of the housing in order to provide an engagement means for a transceiver module being mounted therein. In an embodiment, the tabs also provide for engagement of a bezel which is mounted over the nose of the housing assembly.

A multi-port receptacle is provided comprising an integral multi-port receptacle for making electrical connection, the receptacle comprising a housing forming at least two ports, each port including a first end for receiving a module therein, a second end having an electrical connector and a passageway formed between the first end and the second end and each port is formed on at least three sides by walls formed by the housing and an exterior surface portion being conductive and the housing being mounted to a metal base plate. In an embodiment, the metal base plate has a rear portion which is bent at approximately 90 degrees from the major surface of the base and including a cutout portion adjacent the ejection spring support. A pair of ejection springs is provided at the end of the ejection spring support.

A method of assembling a multi-port receptacle is provided comprising the steps of providing a base, providing a housing that defines at least two ports and including a first mounting feature, a first end, a second end; mounting an electrical connector within the second end of each port and mounting the housing to the base by having second mounting features mated to the first mating features of the housing. In an embodiment, the method of assembly further comprises the insertion of the base having a cutout at the second end of the base, mounting an electrical connector within the housing and sliding the base into the housing so that the cutout straddles the electrical connector and is inserted behind the electrical connector between the electrical connector and the second end of the housing. In an embodiment, the base is attached to the housing by the insertion of a tab of the base over a mounting feature protruding from a wall of the housing to provide a latching mechanism between the base and the housing. In an embodiment, the assembly of the multi-port receptacle further comprises the steps of providing a completely assembled multi-port receptacle and mounting the entire modular unit to a motherboard wherein the mounting pegs of the base plate are mounted to holes in the motherboard simultaneously with the mounting of the contact tails of the electrical connector to a land grid array pattern on the motherboard.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF A PRESENTLY PREFERRED EMBODIMENT

Figure 1:
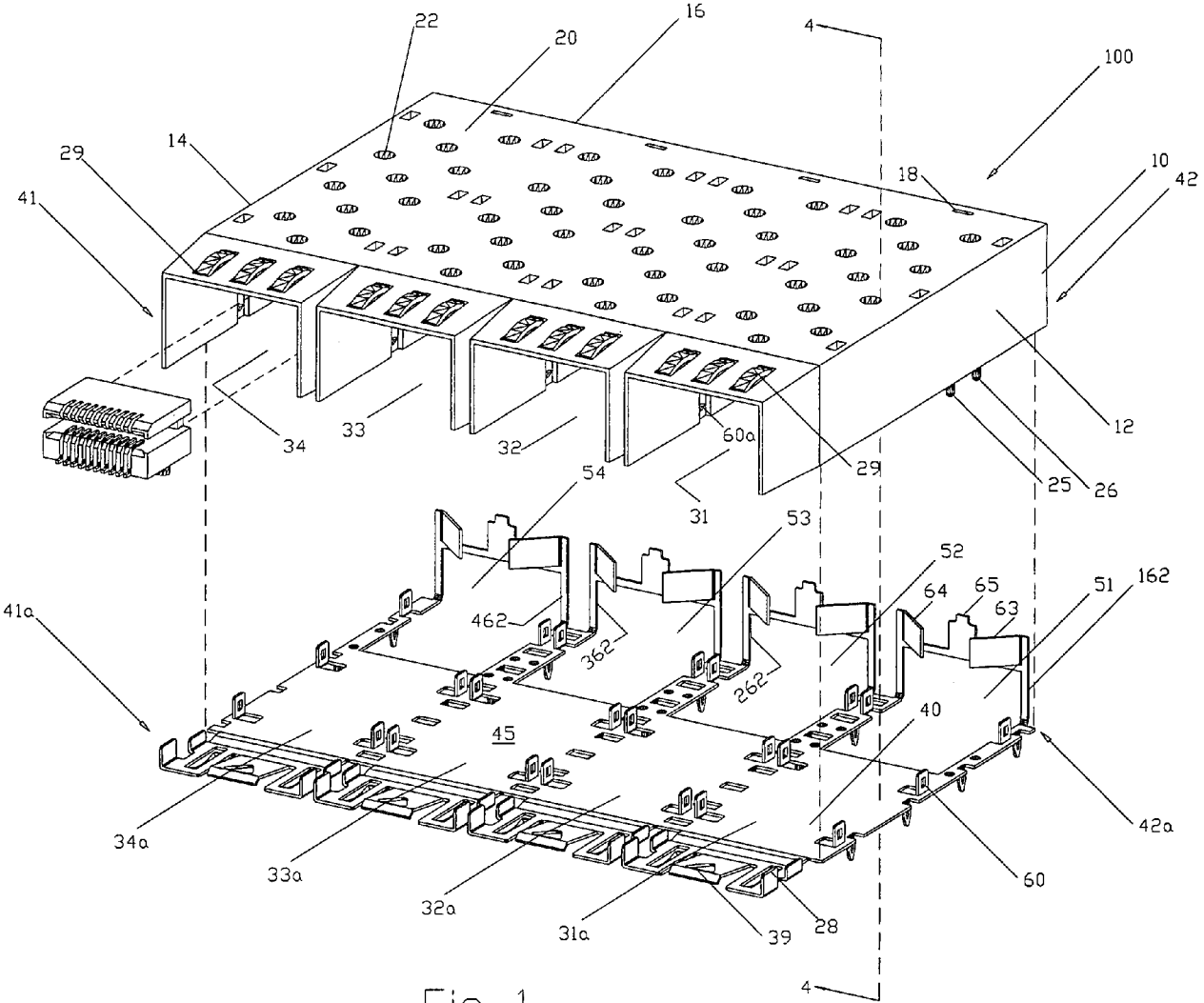
FIG. 1 is an exploded perspective view of an embodiment of the multi-port receptacle of the present invention.

FIGS. 1–9 disclose a presently preferred embodiment of a multi-port receptacle assembly. Turning to FIG. 1 an exploded view of a multi-port receptacle 100 is depicted. Housing 10 includes outer sides 12, 14 and 16 and top surface 20. In an embodiment, the top surface includes a plurality of holes 22 formed therein. The holes 22 provide air flow and may aid in the dissipation of heat developed within the receptacle when an electronic device such as a transceiver module is inserted therein. The housing, in an embodiment, forms a first port 31, second port 32, third port 33 and fourth port 34. It may be understood that the present invention may have any number of ports greater than two. The housing may include alignment pins 25, 26. A base plate 40 is provided which includes a substantially planar major surface 45. The base 40 includes a first end 41*a* and a second end 42*a*. At the second end 42*a* are cutouts 51, 52, 53 and 54 and ejection spring supports 162, 262, 362, 462 which include a pair of ejection springs 63, 64 and a mounting tab 65. The cutouts 51, 52, 53 and 54 are contained at the second end 42*a* and within ejection spring supports 162, 262, 362, 462. The ejection spring supports are formed by bending the second end 42*a* at approximately 90° to the plane of the major surface 45 of the base 40.

The base 40 is divided into segments 31*a*, 32*a*, 33*a* and 34*a*, each of which corresponds to each port 31, 32, 33, and 34 formed by the housing 10. Each segment 31*a*, 32*a*, 33*a* and 34*a* of the base 40 includes mounting features 60 defining its perimeter, a cutout 51, and a ejection spring support 162, 262, 362, 462. Generally, the housing 10 is assembled to the base 40 by movement of the two parts together so that each first mounting feature 60 latches with corresponding second mounting feature 60*a* on the housing 10. The assembly of the housing 10 to the base 40 will be described in more detail below with regard to FIGS. 4–8.

Figure 2:
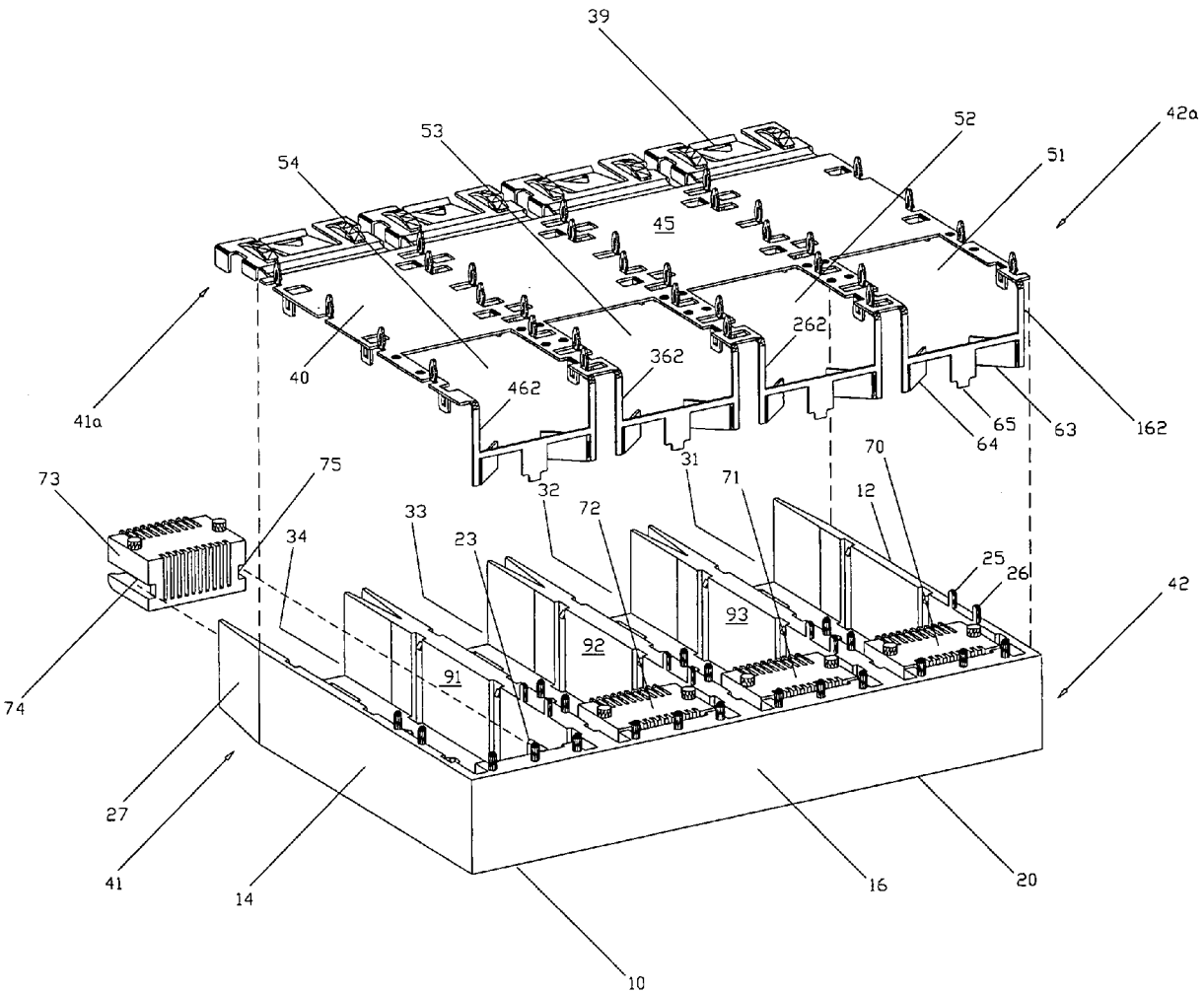
FIG. 2 is an exploded perspective view similar to FIG. 1 but showing the multi-port receptacle from the bottom side.

Turning to FIG. 2, the multi-port receptacle will be described further where like numerals in FIG. 1 and FIG. 2 describe common elements. The housing 20 is shown in an inverted orientation from FIG. 1 showing a bottom view so that each of the ports 31, 32, 33, and 34 are exposed. It can be seen that mounted in port 31, 32 and 33 are electrical connectors 70, 71 and 72. Electrical connector 73 is shown in an unmated condition adjacent the nose 27 of the housing 20. The electrical connector 73 includes first channel 74 and a second channel 75 on an opposing side of the connector insulator housing. In an embodiment, the assembly of the multi-port receptacle begins with the step of mounting the electrical connectors therein. Each port 31, 32, 33 and 34 includes a pair of mounting guides. In an embodiment a mounting guide 23 protrudes from a mounting guide support 57 (see FIG. 4) and is adjacent the inner wall 91. A corresponding mounting guide is present adjacent outer wall 14 protruding into the port 34. Likewise, pairs of mounting guides are also located protruding into ports 31, 32, and 33. The mounting guides for ports 32 and 33 are provided adjacent to inner walls 92 and 93, respectively and the mounting guides for port 31 include a guide adjacent outer wall 12 and a corresponding mounting guide adjacent inner wall 93 protruding into the port 31. In an alternate embodiment, the mounting guides 23 may be attached to the walls 14, 91, 92, 93, 14. Therefore it may be understood, for example, with regard to electrical connector 73 that it is inserted into the port 34 laterally through the passage formed between the first end 41 toward the second end 42 will provide for the channels 74, 75 of the electrical connector 73 to be aligned with the mounting guides 23 within the port 34 so that the electrical connector 73 may be slidingly mated within the second end of the port 34. A locking feature may be provided on the mounting guides 23 and the corresponding channels 74,75 of the electrical connector so that when the electrical connector is inserted all the way back towards the second end 42 the electrical connectors may be locked in position. In addition, In an embodiment, polarizing features may be provided on either or both the electrical connector 73 or the housing 10 in order to polarize the electrical connector 73 so that it may only be inserted in a single orientation so that if it were rotated 180° (either horizontally or vertically) it could not be mated within the port 34.

Figure 3:
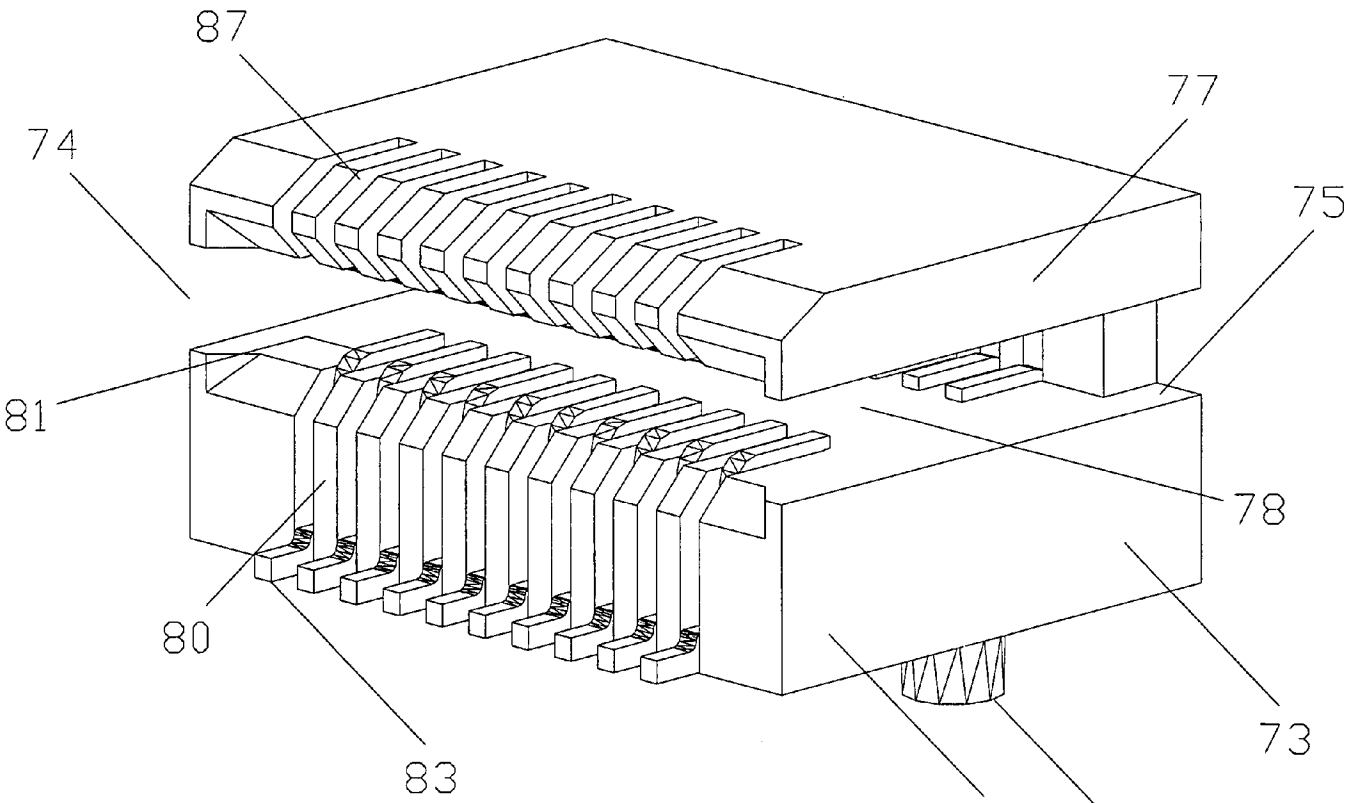
FIG. 3 is an enlarged perspective view of an electrical connector of the present invention.

FIG. 3 is an enlarged perspective view of an electrical connector 73 of a preferred embodiment to be mounted within the multi-port receptacle 100. The electrical connector 73 includes channel 74, 75 on the sides of the insulated housing. A base 76 is provided and an upper surface 77 separated by a slot 78 from the base 76. In an embodiment, the electrical connector 73 may receive a card edge-type connection (not shown). However, any type of electrical connector may be mounted within the housing in order to mate with any type of male, female or combination connection or connector inserted within the port. Mounted within channels 80 in the base 76 are metallic contacts 81 which contact metallic fingers of a card edge inserted into the slot 78. Each contact 81 also includes a contact tail 83. The contact tail 83, in an embodiment, is a surface mount tail which is to be mounted to a land grid array pattern on a motherboard to which the multi-port receptacle 100 is to be mounted. A mounting peg 86 is provided protruding from the base 76 of the electrical connector 73 in order to help align the electrical connector 73 to motherboard. In an embodiment, electrical contact 87 may also be mounted within the upper portion 77 of the electrical connector 73.

Figures 4, 5, 6:
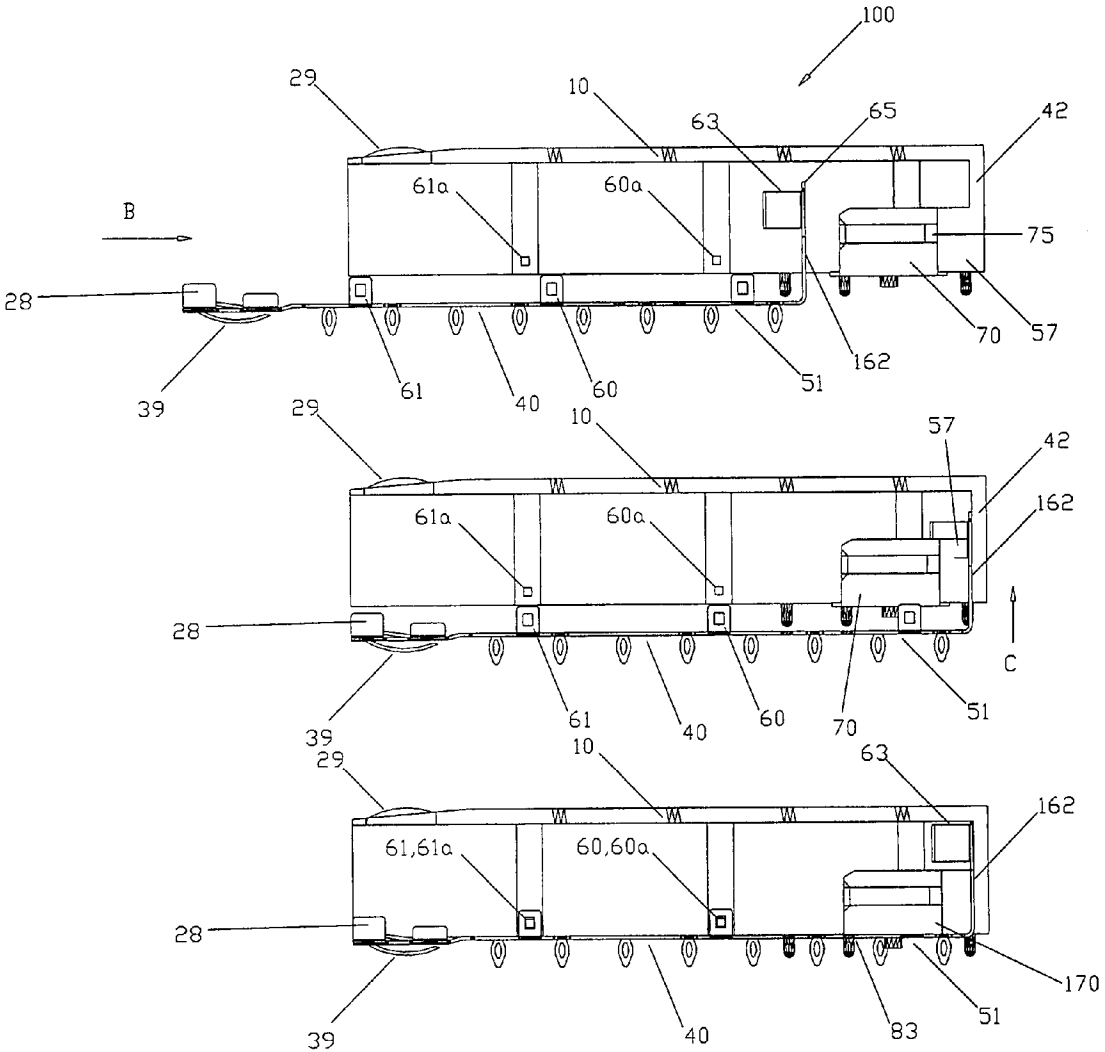
FIG. 4 is a first assembly step of the base to the housing of the multi-port module of the present invention.
FIG. 5 is a second step in the assembly of the base to the housing of the multi-port receptacle of the present invention.
FIG. 6 is a third step in the assembly of the base to the housing of the multi-port receptacle of the present invention.

Referring to FIGS. 4–8 a description of the assembly of the multi-port receptacle 100 in a preferred embodiment will be described. As discussed previously the first step in assembling the multi-port receptacle 100 is the mounting of electrical connector 70, 71, 72 and 73 therein. This assembly was shown in FIGS. 1–2. FIGS. 4–6 depicts a section view of housing 10 and base 40 taken at line 4—4. The housing 10 with electrical connector 70 is depicted mounted therein.

It can been seen that a mounting guide support 57 is provided between the electrical connector 70 and the second end 42 of the housing 10. As discussed above, locking features of the electrical connector 70 and the mounting guides within the ports will lock the electrical connector 70 in position so that the electrical connector 70 abuts against the mounting guide support 57.

Each of the electrical connectors 70, 71, 72 and 73 are mounted within their respective ports within the housing 10. The base plate 40 is then mounted to the housing according to the following steps. The base portion is inserted horizontally within the housing 10 in direction of arrow B. Each segment 31*a*, 32*a*, 33*a* and 34*a* of the base 40 is aligned with each corresponding port 31, 32, 33 and 34. Each ejection spring support 162, 262, 362, 462 of the base 40 is aligned within its corresponding port. As the base 40 is moved horizontally through the passageway within each port the ejection spring support 162, 262, 362, 462 is guided between the walls 12, 93, 92, 94, 14, respectively. As is depicted in FIGS. 1 and 2, the ejection spring supports 162, 262, 362, 462 include a cutout 51, 52, 53 and 54. The cutout is provided at the second end 42*a* of the base 40 and also forms an open space along the interior of each ejection spring support 162, 262, 362, 462. The cutout 51, 52, 53 and 54 allows for the ejection spring supports 162, 262, 362, 462 to straddle and be slid over each of the connectors 70, 71, 72 and 73.

Turning to FIG. 5, it can be seen that the ejection spring support 162 has been slid over electrical connector 73 and the mounting guide support 57 at the second end 42 of the housing 10. With the base 40 slid all the way horizontally into the housing 10, the first mounting features 60, 61 of the base 40 are aligned with second mounting features 60*a*, 61*a* of the housing 10. The base 40 is then moved in direction of arrow C vertically upward into the port 31 of the housing 10. Upon insertion of the base 40 with each of the ejection spring supports 162, 262, 362, 462 pushed up inside the ports 31, 32, 33 and 34, the first mounting features of the base 60, 61 will latch with the second mounting features of the housing 60*a*, 61*a*. As shown in FIG. 6, the base 40 is fully mounted to the housing 10 so that the mounting features 60, 60*a*, 61 and 61*a* are latched together. It may be understood that multiple latching features are provided on the base 40 and the housing 10. In an embodiment, each segment 31*a*, 32*a*, 33*a* and 34*a* includes at least 6 latch features on the base 40 and 6 corresponding latch features on the housing 10.

Figure 8:
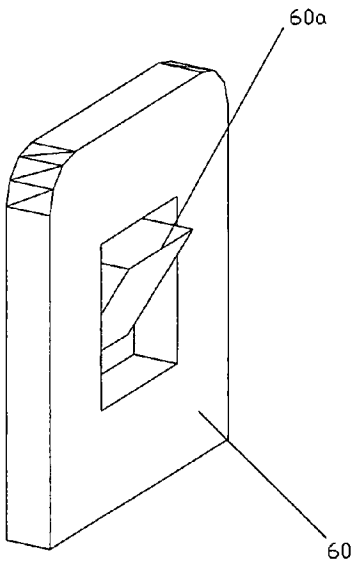
FIG. 8 is an isolated perspective view of the mounting features of the housing and base of the present invention shown in a mated orientation.
Figure 7:
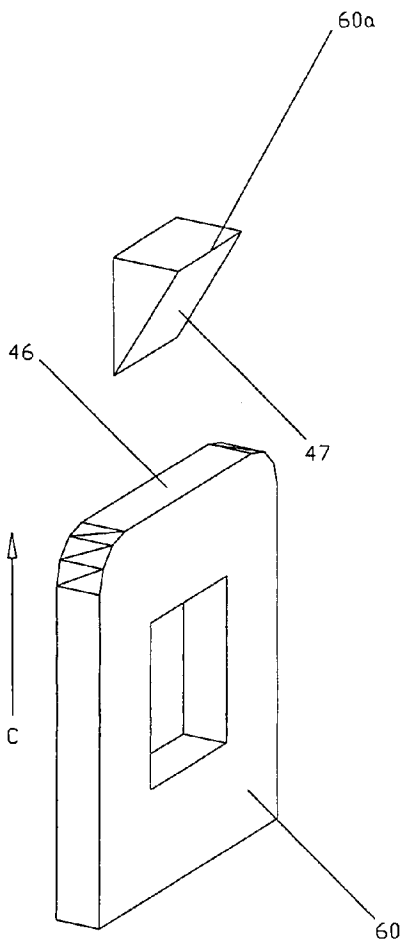
FIG. 7 is a isolated perspective view of the mounting features of the housing and base of the present invention shown in an unmated orientation.

Turning to FIGS. 7 and 8 a more detailed description of the first and second mounting features are disclosed. FIG. 7 discloses an isolated view of the mounting features of an embodiment of the invention wherein first mounting feature 60 would be protruding from the base 40 (not shown) and second mounting feature 60*a* would be protruding from the housing 20 (not shown). In an embodiment, first mounting feature 60 may be a tab having a square shape and a square hole in its center. In an embodiment second mounting feature of the housing 60*a* may be a boss having a pyramidal shape. As the tab 60 is moved in direction of arrow C, when the base 40 is vertically inserted within the housing 10 the top edge 46 of the tab 60 abuts against ramped surface 47 of the boss 60*a*. As the tab 60 continues to move in direction of arrow C, the tab will slide against the ramped surface 47 and the tab deflects outwardly. However, it may be understood that FIGS. 7, 8 are examples of mounting features and any other known means of mounting two pieces together may be used.

Turning to FIG. 8, the first and second mounting features 60, 60*a* are shown in a mated condition where the boss 60*a* is shown inserted within the hole of the tab 60. Upon insertion of the boss 60*a* within the hole of the tab 60, the tab 60 flexes back to a vertical position and locks over the flat top edge of the boss 60*a*. It may understood that with multiple mounting features 60, 60*a* located all around the base 40 and the housing 10, the simultaneous latching of each mounting feature of 60, 60*a* will provide for a secure attachment of the base 40 to the housing 10. In an embodiment, it is preferred that the base 40 not be removed from the housing 10 and substantial force will be required to unlatch the tab 60 from the boss 60*a*. However, tools may be provided in order to unlatch each tab 60 from the boss 60*a*.

Upon mating of the mounting features 60, 60*a*, the multi-port receptacle 100 is completely assembled in a modular unit including the electrical connectors 70, 71, 72 and 73 mounted therein. As shown in FIG. 6 the base of each electrical connector 70, 71, 72, 73 is generally coplanar with base 40 and contact tails 83 protrude slightly beyond the plane of the base 40 so that alignment and mounting of the connectors 70, 71, 72, 73 may occur. As well, mounting tab 65 also is latched in place within aperture 18 (see FIG. 1) at the second end of 42 of the housing 10 in order to secure the ejection spring support 162 in a vertical position so that ejection springs 63, 64 protrude into the port 31. The ejection springs 63, 64 in an embodiment will abut against the housing of a transceiver mounted within each port 31 and will provide a force against the module so that when the retention member 39 is released the module will be ejected from the port. This assembled unit 100 may then be delivered to a customer for entry into its inventory system until a host device is ready to be assembled. It may be understood that because the multi-port receptacle 100 has in an embodiment, four ports, the OEM customer may reduce its inventory and handling procedures since it has one complete assembly that provides for four ports. For example, where the prior art individual cages each were two piece assemblies plus a connector (3 parts total) the OEM customer had to purchase, track and mount 12 parts; instead of the sole multi-port assembly 100 of the present invention (when a 4 port device is required). If the OEM has host devices with 12 ports, the present invention reduces the OEM's purchasing, tracking and mounting of 36 individual parts to one 12 port modular assembly. Therefore, it may be understood that in an embodiment the multi-port receptacle may have only two parts, the base 40 and housing 10 in addition to the number of connectors mounted therein, or 2+n parts, where n is the number of ports/electrical connectors.

Figure 9:
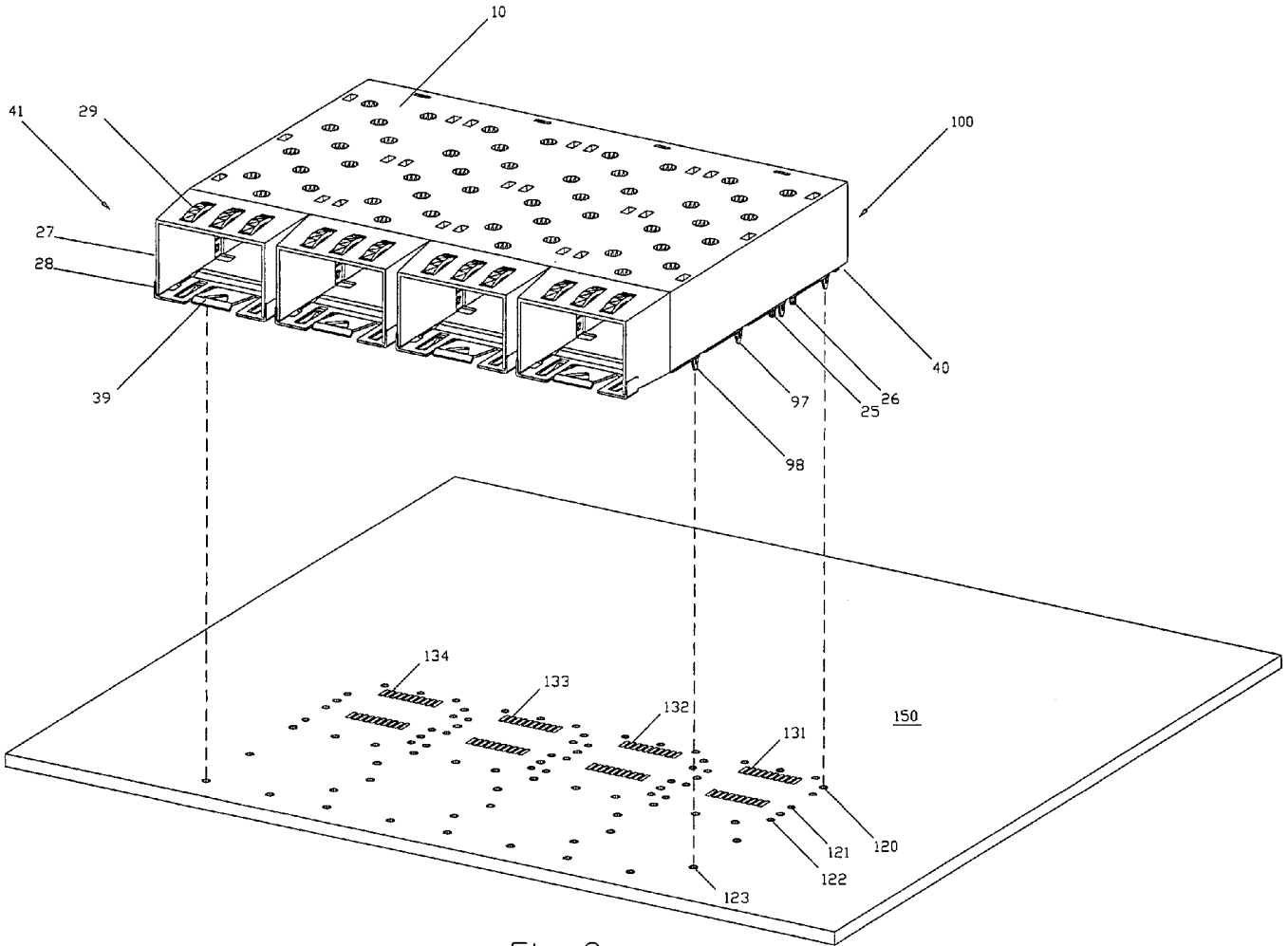
FIG. 9 is a perspective exploded view of an assembled multi-port receptacle assembly of the present invention being mounted to a motherboard of a host device.

Turning to FIG. 9, the completed assembly of the multi-port receptacle 100 is depicted. Mounting pins 25, 26, 97, 98 protruding from the base 40 are received by mounting holes 120, 121, 122, 123 of a motherboard 150 in order to mount the multi-port receptacle assembly 100 to the motherboard 150. The motherboard 150 includes land grid array patterns 131, 132, 133 and 134 for receiving the corresponding electrical connectors 70, 71, 72 and 73 mounted in the corresponding ports 31, 32, 33 and 34 of the multi-port receptacle assembly 100. Therefore it may be understood that simultaneously upon mounting of the mounting pins 25, 26, 97, 98 the contact tails 83 (FIG. 3) of each electrical connector 73 will be aligned with the land grid array patterns 131, 132, 133 and 134. In an embodiment, the land grid array patterns may have solder thereon. After the multi-port receptacle assembly 100 has been mounted to the motherboard 150, the motherboard may be populated with other components and then placed in a solder reflow oven so that the electrical connectors 70, 71, 72 and 73 may be permanently mounted and electrically connected to the motherboard 150. After solder reflow and curing, the motherboard 150 is removed and a bezel or faceplate may be attached to the motherboard 150 so that the nose 27 of each port 31, 32, 33, 34 protrude through the bezel. In an alternate embodiment, the motherboard may be mounted with inside a host-device, such as a router or a hub or a computer, which includes a housing that includes a bezel having openings therein which the nose 27 of the multi-port receptacle assembly will protrude through. In an embodiment, the nose portion 27 at the first end 41 will protrude through the bezel so that electronic devices may be inserted therein. For example, SFP transceiver modules may be mounted into each of the ports 31, 32, 33, 34 of the receptacle assembly 100. However, any other type of electrical component may also be mounted within the ports.

In an embodiment, the nose 27 is tapered so that the outer diameter of the nose is less than the outer diameter of the main body of the housing 10. In an embodiment, the housing is molded of plastic which may require relatively thick walls (approximately 0.080–0.095 inches) which must be reduced at the nose 27 so that a standard opening of a bezel may be placed over it. The nose 27 of the housing 10 in an embodiment includes ground tabs 29 and 28. The tabs 29 are formed by the housing 10. In an embodiment the tabs 29 are integrally molded as one-piece with the rest of the housing 10. The tabs 28 are formed by the base 40. In an embodiment a retention member 39 is also provided by the base adjacent tabs 28. In an embodiment, when the bezel (not shown) is attached to the host device and slid over the nose 27 of the multi-port receptacle assembly 100 the ground tabs 28, 29 abut against the edges of the bezel in order to provide an electrical connection between those surfaces. The retention member 39 is provided by the base 40 and may receive a protruding retention tab of a transceiver to be mounted within each port. The retention member 39 may include a notch to receive a release tab of a transceiver in order to retain the electrical component or transceiver module that is mounted therein. When the release tab is released from the notch of the release member 39, the ejections springs 63, 64 push against the back of the module and eject it at least partially from the port so that the front end of the module may be grasped between two fingers for complete removal.

In an embodiment, the bezel is conductive and the nose 27 of the multi-port receptacle assembly is also metallic and/or conductive including ground tabs 28 and 29. Therefore an electrical connection is made between the bezel and the nose 27 of the multi-port receptacle assembly 100. Therefore, if the bezel is at a ground potential, the multi-port receptacle assembly will also achieve a ground potential similar to the bezel. This is a preferential arrangement when high-speed electrical components are being mounted within the ports 31, 32, 33, 34 in order to provide for dissipation of electrostatic charge and also for electromagnetic interference (EMI) shielding. In an embodiment, the housing 10 is injection molded of plastic and is then metalized. In an embodiment, a plastic such as Amodel® by BP Amoco may be used due to its high temperature and ability to retain plating, even when exposed to soldering processes. In an embodiment, the plastic housing 10 may be metalized via the steps of plating the housing with a first layer of copper and then a plating of nickel may be applied. In an alternate embodiment, a copper nickel chrome plating may also be applied to provide a shiny appearance. Such metalized coatings provide a highly conductive surface that will enhance EMI shielding and also a discharge of electrostatic charges. In an embodiment, the molding of the housing may also include molding of the electrical connectors simultaneously so that the electrical connector and housing is all one piece. In an embodiment, the base is stamped of metal such as stainless steel.

The matter set forth in the foregoing description and accompanying descriptions is offered by way of illustration only and not as a limitation. While particular embodiments have been shown and described, it will be obvious to those skilled in the art that changes and modifications may be made without departing from the broader aspects of applicant's contribution. The actual scope of the protection sought is intended to be defined in the following claims when viewed in their proper perspective when based on the prior art.

What is claimed is:

1. A multi-port receptacle comprising:

a monolithic housing defining at least two ports, each port including:

first end defining an opening for receiving a module;

a second end defining a wall; and a passageway formed between the first end and the second end;

the housing further comprising a divider wall dividing each port;

a base having a planar major surface including at least a pair of end segments adjacent to the first end of the housing, the planar major surface forming a single plane extending between at least two ports and the ports being divided by the divider wall of the housing and the base having integral ejection spring supports formed adjacent to the second end of the housing; and an electrical connector mountable within the second end, the electrical connector disposed within a cut-out portion of the base so that upon mounting of the multi-port receptacle to a motherboard the electrical connector is substantially colinear with the passageway.

2. The multi-port receptacle assembly of claim 1, wherein the base is formed by a plate extending and enclosing approximately an entire side of the housing.

3. The multi-port receptacle assembly of claim 1, wherein the base includes first mounting features for latching to corresponding second mounting features of the housing.

4. The multi-port receptacle assembly of claim 1 comprising the housing injection molded of plastic.

5. The multi-port receptacle assembly of claim 1, wherein the base is formed of a metal plate.

6. A multi-port receptacle of claim 1, wherein the ports include a first mounting guide and the electrical connector includes a second mounting guide to correspondingly engage the first mounting guides in order to mount the electrical connector within the ports.

7. A multi-port receptacle of claim 1, wherein the base includes a ejection spring support at the second end having the cut-out formed therein.

8. The multi-port receptacle assembly of claim 7, wherein the contacts of the electrical connector are generally coplanar with the cutout and a major surface of the base.

9. A multi-port receptacle assembly of claim 8, wherein the ejection spring support includes ground tabs protruding into the passageway of the port.

10. The multi-port receptacle of claim 1, wherein the housing is metalized.

11. The multi-port receptacle assembly of claim 1, wherein the housing is plated.

12. The multi-port receptacle assembly of claim 1, wherein the base is segmented by a group of at least six first mounting features forming a perimeter of each segment and a plurality of second mounting features of the housing corresponding to the first mounting features in order to securely attach the housing and base together.

13. An integral multi-port module receptacle and motherboard assembly comprising:

a monolithic housing forming at least two ports, each port including a first end for receiving a module therein, a second end having an electrical connector and a passageway formed between the first end and the second end and the each port is formed on at least tree sides by walls formed by the housing and on a fourth side by a base plate formed by a planar major surface having a single plane extending between the at least two ports when the housing is attached to the base, wherein the base plate includes an aperture and integral ejection spring supports in which the electrical connector is disposed.

14. The assembly of claim 13, wherein the port includes a pair of mounting guides and the electrical connector includes a pair of channels on the sides of the electrical connector for slidingly engaging the pair of mounting guides.

15. The assembly of claim 13, wherein the aperture is formed by a cut-out in the base plate.

16. The assembly of claim 13, wherein the receptacle only has 2+n parts where n is the number of ports.

* * * * *